US007243819B2

(12) United States Patent
Marelli

(10) Patent No.: US 7,243,819 B2
(45) Date of Patent: Jul. 17, 2007

(54) SIMPLIFIED INVERTIBLE PUMP FOR DISPENSING ATOMIZED LIQUIDS

(75) Inventor: Andrea Marelli, Rozzano (IT)

(73) Assignee: Meadwestvaco Calmar S.p.A., Fizzonasco di Pieve Emanuele (IT)

( * ) Notice: Subject to any disclaimer, the term of this patent is extended or adjusted under 35 U.S.C. 154(b) by 483 days.

(21) Appl. No.: 10/939,517

(22) Filed: Sep. 14, 2004

(65) Prior Publication Data

US 2005/0089423 A1 Apr. 28, 2005

(30) Foreign Application Priority Data

Oct. 24, 2003 (IT) ..... MI2003A2083

(51) Int. Cl.
*B67D 5/40* (2006.01)

(52) U.S. Cl. ..... 222/321.4; 222/376

(58) Field of Classification Search ..... 222/321.4, 222/376, 321.7

See application file for complete search history.

(56) References Cited

U.S. PATENT DOCUMENTS 4,277,001 A 7/1981 Nozawa
4,775,079 A 10/1988 Grothoff
5,222,636 A 6/1993 Meuresch
5,738,252 A 4/1998 Dodd et al.
2005/0089423 A1 4/2005 Marelli

FOREIGN PATENT DOCUMENTS

EP 0 648 545 4/1995
EP 1 029 597 8/2000

OTHER PUBLICATIONS

U.S. Appl. No. 10/917,325, filed Aug. 13, 2004, Marelli.
U.S. Appl. No. 10/939,517, filed Sep. 14, 2004, Marelli.
U.S. Appl. No. 10/946,246, filed Sep. 22, 2004, Marelli.
U.S. Appl. No. 11/276,670, filed Mar. 9, 2006, Marelli et al.

*Primary Examiner*—Philippe Derakshani
(74) *Attorney, Agent, or Firm*—Oblon, Spivak, McClelland, Maier & Neustadt, P.C.

(57) ABSTRACT

Manually operated invertible pump for dispensing atomized liquids, the pump having a very compact structure and an aperture which can be intercepted by the pump piston to control liquid entry into the pump when this is in a downwardly inverted position.

3 Claims, 3 Drawing Sheets

SIMPLIFIED INVERTIBLE PUMP FOR DISPENSING ATOMIZED LIQUIDS

FIELD OF THE INVENTION

The present invention relates to a manually operated invertible pump for dispensing atomized liquids withdrawn from a liquid container, on the mouth of which the pump is mounted usable both in the upright position, i.e. with the pump facing upwards from the container, and in the inverted position, i.e. with the pump facing downwards from the container.

BACKGROUND OF THE INVENTION

Many types of invertible pumps are known, such as those described in U.S. Pat. No. 5,222,636, U.S. Pat. No. 4,775,079, U.S. Pat. No. 4,277,001, U.S. Pat. No. 5,738,252, EP-A-0648545 and EP-A-1029597, however such pumps have serious drawbacks which limit their production and use. In this respect, some are of very complex structure with many component parts difficult to mould and assemble; others entrust the seal to small, light sleeves slidable on the surfaces of a holed cylindrical body, the mobility of such sleeves being very precarious and unreliable; still others are of considerable size below the seal gasket of the ring cap for fixing the pump onto the mouth of a liquid container, either axially (see the two said European patents and U.S. Pat. No. 4,277,001 and U.S. Pat. No. 4,775,079) or transversely (U.S. Pat. No. 5,222,636), making them unsuitable for use on small-dimension containers such as required, for example, in the perfumery field.

The operation of an invertible pump depends on the fact that the liquid enclosed in a container must be able to penetrate into the pump compression chamber by rising along a dip tube (of which one end is mounted on the pump and the other end is free and is positioned in proximity to the container base) when the pump is positioned above the container, but to penetrate directly into said compression chamber from a hole provided in the pump body, and of which the opening is controlled by a unidirectional valve which opens only during pump intake and only when the pump is inverted, i.e. positioned below the container.

SUMMARY OF THE INVENTION

The main object of the present invention is to provide an invertible pump having a structure which is very simple to mould and assemble, and of easy and economical construction, and in particular having a length and width (below and respectively laterally to the pump body) which are equal to or only slightly exceed the dimensions of a similar non-invertible pump. This and other objects are attained by an invertible pump comprising a main body having an upper end and a lower end and defining a chamber within which a piston is sealedly slidable connected to a hollow stem emerging from the upper end of the main body, at the lower end of which there is provided a hole from which there extends a tubular appendix for supporting a dip tube connected to the pump via a unidirectional valve system which is open to enable liquid to arrive in said chamber through the dip tube when the pump is upright, but is closed when the pump is inverted, in the main body there being provided an aperture which is open and free, to enable liquid to arrive directly in the pump chamber when the pump is inverted and in the rest condition, but closes when the pump is operated and its piston moves away from the rest position, wherein said aperture is provided in the upper part of the main body in a position in which it is left free by said piston when the pump is at rest whereas it is closed by said piston when the piston withdraws from its rest position on operating the pump, said unidirectional valve system comprising two balls and a hollow profiled element projecting into said chamber from the lower end of the main body in correspondence with the hole provided at the lower end of the main body, and having two ends both profiled to form seats on which a respective ball can rest and form a seal, one of said balls being disposed within the pump chamber and the other being housed and movable between the hole provided at the lower end of the main body and the cavity of the tubular appendix, said hollow profiled element comprising means for retaining the ball freely oscillable within the pump chamber in proximity to its seat.

Preferably, said hollow profiled element is formed separately from the pump main body and is inserted into and retained in the pump chamber in correspondence with the hole to which the dip tube is connected.

BRIEF DESCRIPTION OF THE SEVERAL VIEWS OF THE DRAWINGS

The structure and characteristics of the invertible pump of the present invention will be more apparent from the ensuing descriptions of two non-limiting embodiments thereof, given with reference to the accompanying drawings, in which.

DETAILED DESCRIPTION OF THE INVENTION

Figure 1:
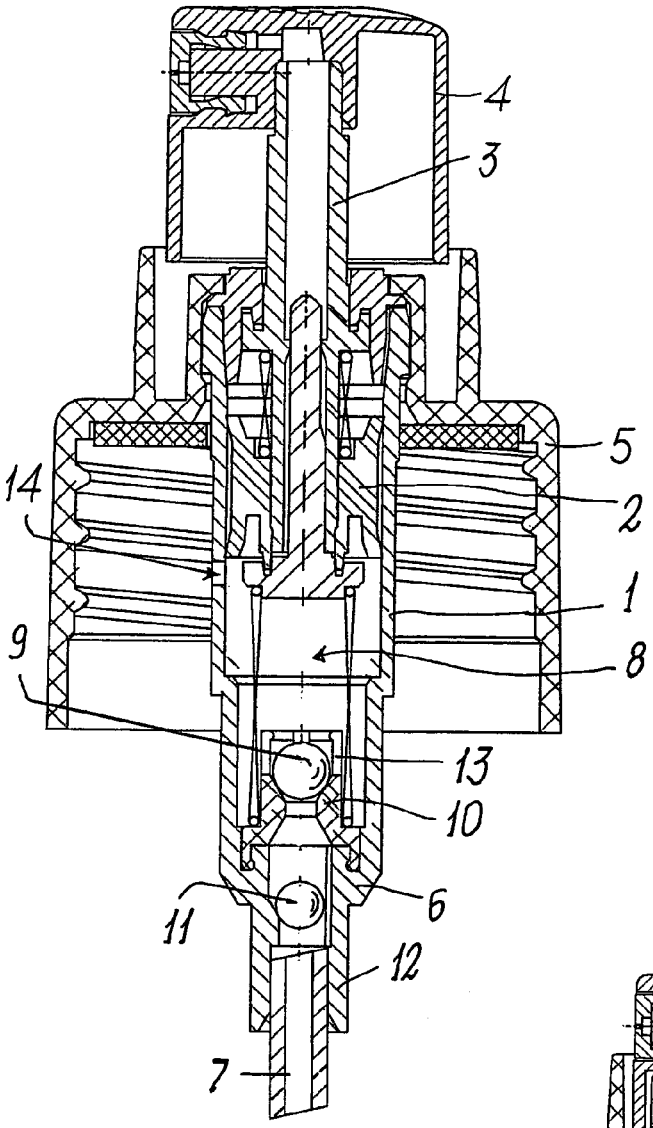
FIGS. 1 and 2 are longitudinal sections through a pump in the upright position, shown respectively at rest and with its piston pressed completely down to dispense an atomized liquid.

The pump shown in FIGS. from 1 to 4 comprises a main body 1 housing a sealedly slidable piston 2, from which there extends a hollow stem 3, the free end of which is inserted into a suitable seat provided in a dispensing cap 4: the body 1 can be rigidly fixed by a threaded ring cap 5 onto the mouth of a container (not shown for simplicity) for the liquid to be dispensed.

Figure 2:
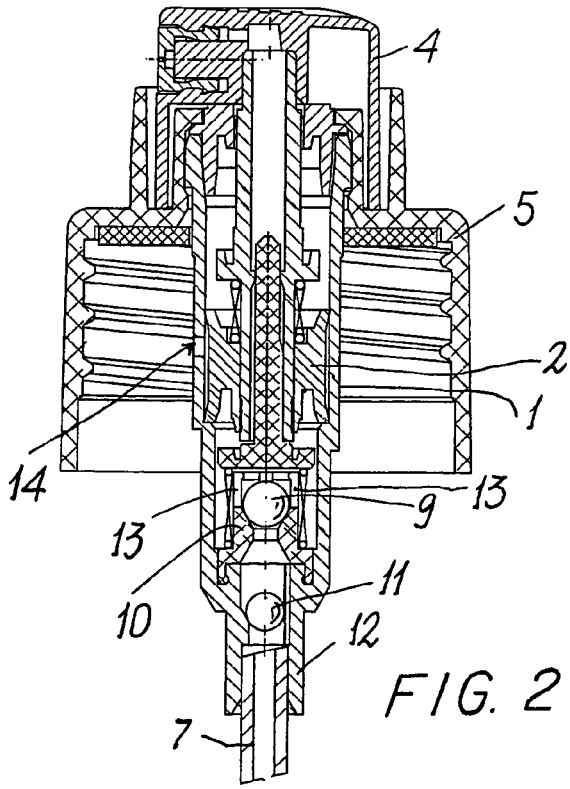

The main body 1 is lowerly bounded by a base wall 6, in the centre of which there is provided a hole connectable to a dip tube 7 which enables the liquid present in the container to rise (when the pump is in the upright position of FIGS. 1 and 2) through the hole in the base wall 6 and to penetrate into the liquid intake and compression chamber bounded within the body 1 by the piston 2 and by a unidirectional seal valve which, in the illustrated example, comprises a small steel ball 9 housed and axially translatable within a housing provided at the upper end of a hollow element 10 in the interior of the chamber or cavity 8, where a profiled seat is provided on which the ball 9 rests and forms a seal when a liquid present in the chamber 8 is put under pressure by operating the cap 6 and with it the stem 3 and piston 2. The structure of the pump shown in the upper part of FIGS. 1 and 2 is of known type and can be structured in various ways: for example that shown in FIGS. 1–4 is totally similar to that illustrated in EP-A-1334774 (but could be as that illustrated in EP-B-0721803, EP-A-0648545, U.S. Pat. No. 3,627,206 or many others).

The new and characteristic part of the pump of the invention relates to the lower part of the pump (with reference to the pump in its upright position of FIGS. 1 and 2), where it can be seen that the hollow element 10 at the upper end of which the seal seat for the ball 9 is provided consists of a hollow profiled element at the lower end of which there is provided a further profiled seat on which a ball 11 rests and forms a seal when the pump is used in the inverted position (FIGS. 3 and 4), the ball 11 enabling liquid to freely pass from the dip tube 7 to the chamber 8 when the pump is used in the upright position (FIGS. 1 and 2) because the ball is housed and translatable within a longitudinally grooved cavity within a body appendix 12 on which the tube 7 is mounted.

The ball 11 is freely oscillable between the hollow element 10 and a projection (not numbered for simplicity) provided in the cavity of the appendix 12, the ball 9 being oscillable between its seal seat on the element 10 and the (inwardly projecting) ends of cylindrical sectors 13 which extend from the element 10.

The element 10 is simply inserted and forced into the cavity 8, its structure being extremely simple and easy to produce with high precision on an industrial scale, because the overall axial length of the element 10 is very small. It can also be seen that assembly of the described pump is very simple because the ball can be inserted into its housing by simply allowing it to fall into the cavity or chamber 8 before inserting into this cavity the element 10 on which the ball 9 has been previously mounted with considerable ease.

Figure 3:
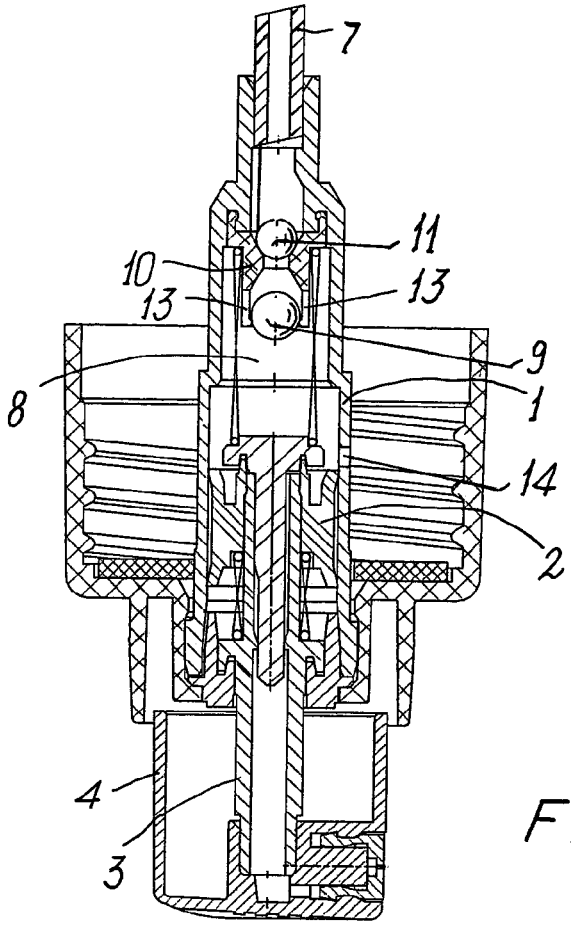
FIGS. 3 and 4 are similar to FIGS. 1 and 2, but show the pump inverted in the same utilization state as the preceding figures.
Figure 4:
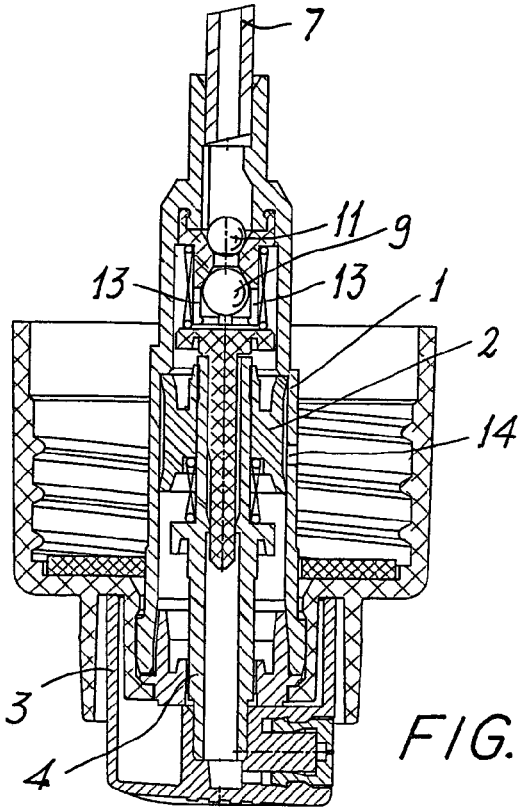

Finally, in the upper part of the main body 1 there is provided an aperture 14 which freely connects the chamber 8 to the outside of the body 1 when the pump is at rest (FIGS. 1 and 3) but is immediately closed by the pump piston 2 as soon as the piston is withdrawn from its rest position on operating the pump (FIGS. 2 and 4).

It will now be assumed that the pump is in the upright vertical position (FIGS. 1 and 2), mounted on a container of liquid to be dispensed.

To prime the pump, the cap 4 is pressed with a finger to lower the piston 2 from the position of FIG. 1 to that of FIG. 2 to immediately close the aperture 14, while the air initially present in the pump chamber is expelled to the outside in traditional known manner, as described in a large number of patents, including those already cited, and in particular in EP-A-1334774.

Starting from the position of FIG. 2, it will now be assumed that the cap is now released so that the pump piston is made to rise by a spring which acts on it: in this manner, a vacuum is formed in the chamber 8 to cause the liquid to rise along the dip tube 7, bypassing the ball 20 and raising the ball 9, to penetrate into and fill the chamber 8.

At the end of its upward stroke, the piston 2 passes beyond the aperture 14, but the liquid present in the chamber 8 cannot pass through this aperture, because the pump is used in the upright position. With the pump hence primed and upright, when the pump is operated the aperture 14 firstly closes to pressurize the liquid present in the chamber 8 and force the ball 9 to press and seal against its seat in the hollow element 10.

The pump can hence be used in the same manner as a common non-invertible pump of similar structure (in particular that of EP-A-1334774).

Reference will now be made to FIGS. 3 and 4 in which the pump is shown in its inverted position, i.e. with the pump body immersed in the liquid contained in the container and with the free end (not shown) of the dip tube 7 open in the air present in the container bottom, now positioned at the top: under these conditions the ball 11 rests and seals against its seat provided on the adjacent end of the hollow element 10 while the ball 9 falls by gravity out of its seal seat (FIG. 3), to be retained by the inwardly projecting ends of the cylindrical sectors 13 of the element 10.

The liquid present outside the pump body 1 flows freely through the aperture 14 to fill the pump cavity 8, when this cavity is under vacuum.

When the pump is pressed to dispense atomized liquid, the piston 2 immediately closes the aperture 14, to compress the liquid present in the chamber 8 and hence raise the ball 9 so that it becomes inserted into and seals against its seat in the hollow element 10: this position is maintained until the piston 2 reaches its end-of-travel position (FIG. 4).

From that stated and illustrated, it is clear that the length of the invertible pump is very small, equal to or only slightly more than that of a common non-reversible pump, thus facilitating its use in many cases (for example in the pharmaceutical and cosmetics fields), and also facilitating its storage, its handling and its despatch from the manufacturer to the user.

The hollow element 10 can be easily produced with high precision (given its very small length) and can be inserted, as can the balls, into the pump body 1 also very easily.

Figure 5:
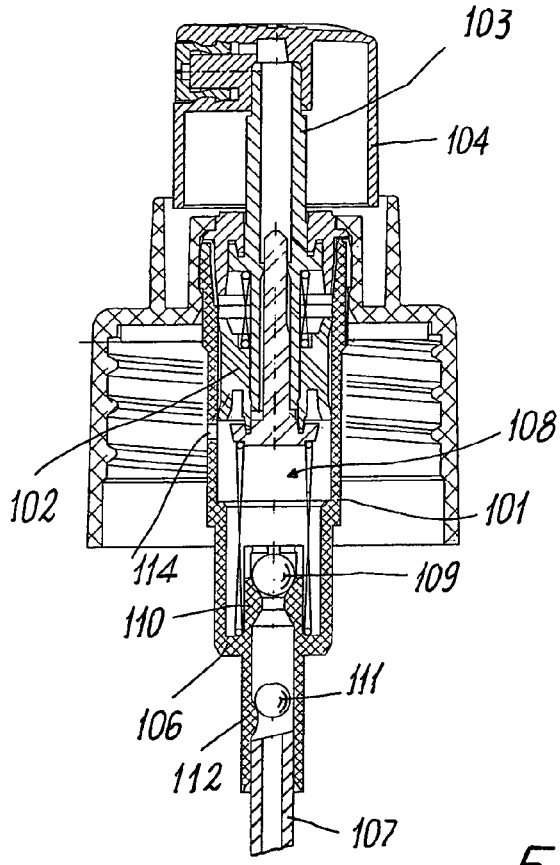
FIG. 5 is similar to FIG. 1, but shows a different embodiment of the invertible pump.

FIG. 5 shows a different (but similar) embodiment of the pump of FIGS. 1–4.

The pumping system applied to the hollow main body 101 will not be described as it is the same as that already described (but could also have a different configuration). Again, in this embodiment the body 101 defines an intake and compression chamber 108 and presents an aperture 114 which is left free by the piston 2 when the pump is in its rest state.

A hollow element 110 rigidly projects from the base 106 of the body 101 and houses two small sealing balls 109, 111 (identical to the already described balls 9 and 11 and having the same function), a dip tube 107 being sealedly mounted on the free end of the appendix 112.

It is not necessary to describe the operation of the pump of FIG. 5, it being the same as that of the pump shown in FIGS. 1–4.

In the pump shown in FIGS. 1–4, the liquid drawn through the dip tube 7 into the appendix 12 through its open free end flows around the ball 9 and then enters the chamber 8 after lifting the ball 9 away from its seal seat in the hollow element 10. The liquid takes an identical path from the dip tube to the intake chamber in the pump of FIG. 5.

Figure 6:
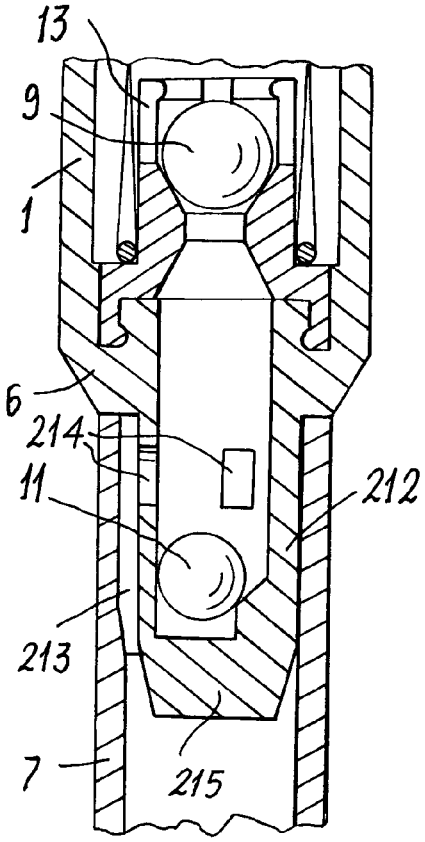
FIGS. 6 and 7 are longitudinal sections through just the lower end portion of a variant of the pump of FIGS. 1 and 2, shown with the pump in the upright and inverted position respectively.
Figure 7:
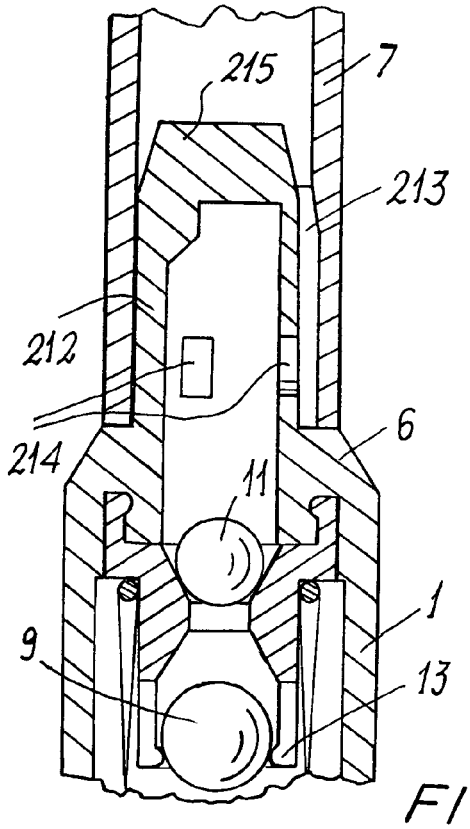

Instead of passing through the open free end of the appendix (12 in FIGS. 1–4; 112 in FIG. 5) to which the dip tube (7; 107) is connected, the free end of the appendix could also be closed as represented in FIGS. 6 and 7, which show only the end portion of a pump (assumed to be similar to that of FIGS. 1–4), in its upright position in FIG. 6 and in its inverted position in FIG. 7.

FIGS. 6 and 7 use the same reference numerals as FIGS. 1–4 to indicate structural parts identical to those of FIGS. 1–4, the operation of which will therefore not be repeated.

With reference now to FIGS. 6 and 7, extending from the base wall 6 of the pump there can be seen a tubular appendix (indicated by the reference numeral 112) having its free end closed by an end wall 215 to hence define a cylindrical cavity in which the ball 11 is housed and movable. On the outer surface of the appendix 212 there are provided longitudinal grooves 213 (only one of which is shown in section in FIGS. 6 and 7), each opening in correspondence with a respective aperture 214 which connects the cavity of the appendix 212 to a respective groove 213.

In FIG. 6, the ball is shown in the position it assumes when the pump is held in the upright position: as the dip tube is mounted on the outer surface of the appendix 212, when the pump is operated to draw liquid from the dip tube 7 the liquid passes through the grooves 213 and penetrates into the cavity of the appendix 212 through the apertures 214, which are provided in an intermediate position along the length of the appendix in order not to be obstructed by the ball 11 which rests on the end wall 215 (FIG. 6). The pump operation is as already described with reference to FIGS. 1–4.

FIG. 7 is similar to FIG. 6 but shows the position assumed by the ball 11 when the pump is held in the inverted position.

As already stated, FIGS. 6 and 7 relate to the embodiment of FIGS. 1–4, however the same structural variant of the tubular appendix can evidently also be applied if the pump is similar to or different from that shown in FIG. 5.

What I claim is:

1. A simplified invertible pump for dispensing an atomized liquid, comprising a main body having an upper end and a lower end and defining a chamber within which a piston is sealedly slidable connected to a hollow stem emerging from the upper end of the main body, at the lower end of which there is provided a hole from which there extends a tubular appendix for supporting a dip tube connected to the pump via a unidirectional valve system which is open to enable liquid to arrive in said chamber through the dip tube when the pump is upright, but is closed when the pump is inverted, in the main body there being provided an aperture which is open and free, to enable liquid to arrive directly in the pump chamber when the pump is inverted and in the rest condition, but closes when the pump is operated and its piston moves away from the rest position, wherein said aperture is provided in the upper part of the main body in a position in which it is left free by said piston when the pump is at rest whereas it is closed by said piston when the piston withdraws from its rest position on operating the pump, said unidirectional valve system comprising two balls and a hollow profiled element projecting into said chamber from the lower end of the main body in correspondence with the hole provided at the lower end of the main body, and having two ends both profiled to form seats on which a respective ball can rest and form a seal, one of said balls being disposed within the pump chamber and the other being housed and movable between the hole provided at the lower end of the main body and the cavity of the tubular appendix said hollow profiled element comprising means for retaining the ball freely oscillable within the chamber in proximity to its seat.

2. An invertible pump as claimed in claim 1, wherein said hollow profiled element is formed separately from the pump main body and is inserted into and retained in the pump chamber in correspondence with the hole at the lower end of the main body.

3. An invertible pump as claimed in claim 1, wherein the free end of said tubular appendix is closed by an end wall, on the outer surface of said tubular appendix there being provided at least one groove which extends from the closed end of the appendix to an aperture which is provided in the appendix and connects the cavity of the appendix to said groove said aperture, being provided in the appendix in an intermediate position along its length.

* * * * *